United States Patent [19]

Hart

[11] 4,158,942

[45] Jun. 26, 1979

[54] METHOD OF FORMING A FLOOR ASSEMBLY AND PRECAST CONCRETE SLABS THEREFOR

[76] Inventor: Wayne C. Hart, 302 E. Joppa Rd., Towson, Md. 21204

[21] Appl. No.: 818,866

[22] Filed: Jul. 25, 1977

[51] Int. Cl.[2] ..... E04B 1/04

[52] U.S. Cl. ..... 52/745; 52/220; 264/35

[58] Field of Search ..... 52/741, 743, 744, 745, 52/220, 79.1, 79.9–79.13, 404, 405; 264/31, 32, 35

[56] References Cited

U.S. PATENT DOCUMENTS

| | | | |
|---|---|---|---|
| 3,555,763 | 1/1971 | Bloxom | 52/745 |
| 3,902,212 | 9/1975 | Muller | 52/745 |
| 3,908,324 | 9/1975 | Stout | 52/405 |
| 3,918,222 | 11/1975 | Bahramian | 52/745 |
| 3,959,423 | 5/1976 | Boyd | 264/35 |
| 3,996,717 | 12/1976 | Sallenave et al. | 264/35 |

FOREIGN PATENT DOCUMENTS

| | | | |
|---|---|---|---|
| 613911 | 12/1948 | United Kingdom | 264/35 |

*Primary Examiner*—J. Karl Bell
*Attorney, Agent, or Firm*—Cushman, Darby & Cushman

[57] ABSTRACT

A precast concrete slab is formed by positioning open-ended access units at selected locations at the bottom of a mold and providing an arrangement of parallel channels over the interior ends of the access units. Concrete then is poured into the mold to surround the sides of the access units and the exposed areas of the channel arrangement. After the concrete has cured, the casting is removed from the mold and is inverted. A floor assembly is produced by supporting the ends of at least two slabs in spaced relationship with their respective channels axially oriented. Connectors are positioned in axial alignment with the channels to interconnect them, and a header having at least one channel therein is positioned to overlie the connectors such that the header is located in the space between the ends of the slabs and extends in a direction substantially normal to the axial orientation of the channels in the slabs. Concrete is poured between the ends of the slabs to fill the areas not occupied by the connectors and the header.

1 Claim, 2 Drawing Figures

METHOD OF FORMING A FLOOR ASSEMBLY AND PRECAST CONCRETE SLABS THEREFOR

BACKGROUND OF THE INVENTION

The present invention relates to preformed concrete slabs for construction purposes and a method of forming a floor assembly therefrom.

In the erection of large buildings having concrete floors, it is conventional to provide channels within the concrete for the passage of electrical lines used to provide power and communications to various parts of the building. Typically, a channel arrangement for the electrical lines is provided by forming hollow areas within the concrete or by embedding pipes or ducts therein. When ducts are used, interior partitions separate the duct into parallel channels. In the case where channels are metal, the channels serve to shield conductors for communication purposes positioned in selected channels from the influence of magnetic fields generated by power lines within adjacent channels. For example, if a metal ductwork is divided into three parallel channels by interior metallic partitions, the power transmission lines typically are placed in one of the channels while communication lines joined to telephones, data processing units, etc., are selectively positioned in adjacent channels. Consequently, the power lines are completely enclosed within a metal shield, thereby preventing the fields they generate from interfering with the communication links.

Obviously, using a channel arrangement such as that just described, the electrical lines are oriented in a particular direction with respect to the building under construction. If channels are provided in the several preformed slabs which are used to construct a floor of the building under construction, the result is a multiplicity of sets of parallel channels known as raceways. In order to complete a network of electrical lines, it is therefore necessary to provide further channels extending substantially transversely to the multiplicity of raceways embedded in the concrete slabs. This is accomplished by additional channel arrangements called headers. To provide a passage from a header to the raceways in the concrete slab, access units are provided at the points of overlapping intersection between the header and the raceways. An access unit typically is an open-ended device positioned to overlap knock-out holes provided in the header and the embedded raceways. Accordingly, to connect, for example, a main power line within the header to a selected power line positioned in a specific raceway, knockouts are removed at the points of overlap of the header and the appropriate raceway, and a splice is made which passes through the knock-outs. Also, to provide passages from the raceways to specific areas of the final floor surface, additional access units are selectively positioned over knock-outs in the raceways.

Conventionally, when a building is constructed using preformed slabs, each slab is positioned in its proper location extending between support beams. The access units are placed on top of the slabs at the locations prescribed by the building plans and headers are appropriately positioned. Concrete then is poured to surround the access units and headers, thereby covering the slabs and bringing the concrete floor up to its prescribed final level where its surface is finished.

From the foregoing discussion, it can be seen that while the use of preformed slabs facilitates the construction of the floor, and reduces the amount of concrete which must be poured at the construction site, nevertheless, a substantial concrete pouring is required in order to complete the encapsulation of the electrical channels and to provide a smooth surface to the floor.

In accordance with the present invention, an improved method is provided for fabricating preformed slabs and forming a floor assembly therefrom so as to eliminate the requirement that an entire floor be poured on site.

SUMMARY OF THE INVENTION

The process of fabricating precast concrete slabs according to the present invention comprises selectively locating access units at the bottom of a mold; providing parallel channels over the upper ends of the access units; casting concrete in the mold to surround the exposed areas of the channel arrangement and the sides of the access units; and after the concrete is cured, removing the casting from the mold and inverting it, whereby the bottom surface of the casting as it was positioned within the mold becomes the finished smooth top surface of the floor to be constructed.

Using slabs of this type, a floor assembly may be formed by supporting the ends of at least two slabs in spaced relationship with their respective channels axially oriented. Connectors are positioned in axial alignment with the channels to interconnect them, and a header having at least one channel therein is positioned to overlie the connectors such that the header is located in the space between the ends of the slabs and extends in a direction substantially normal to the axial orientation of the channels in the slabs. Concrete is poured between the ends of the slabs to fill the area not occupied by the connectors and the header.

The invention will be described in further detail with reference to the accompanying drawings, wherein:

FIG. 1 is a diagrammatic perspective view of a preformed slab as it is cast; and FIG. 2 is a side elevational view of a portion of a floor constructed utilizing a preformed slab molded in accordance with the present invention.

DETAILED DESCRIPTION OF THE INVENTION

Figure 1:
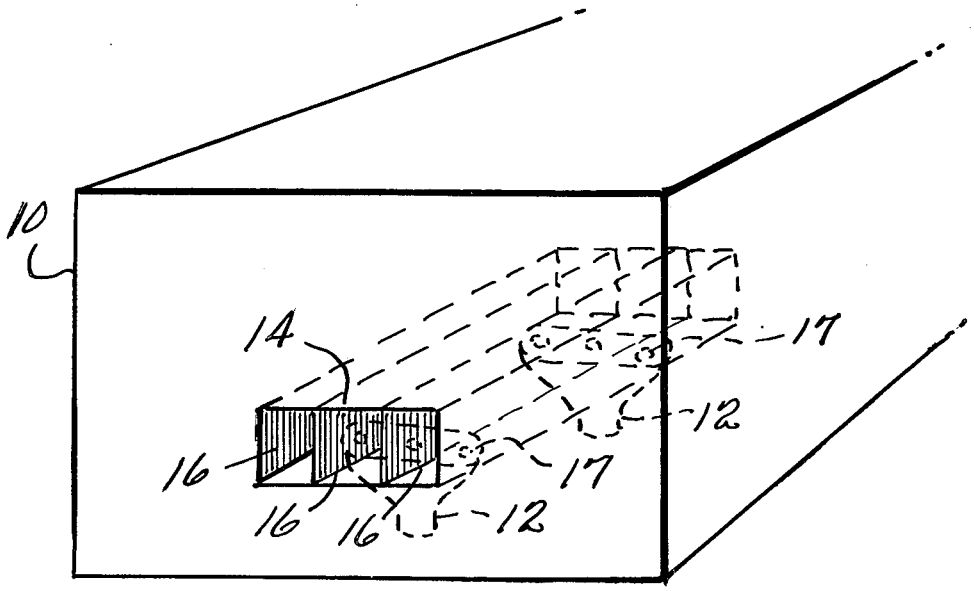

Referring to the drawings, there is disclosed in FIG. 1 a mold, generally indicated by numeral 10. This mold typically is an elongated rectangular shape provided with a smooth-surfaced bottom. At locations along the bottom of the mold, selected in accordance with the plans of a building to be constructed, conventional open-ended access units 12 are provided. Ductwork 14 (only one length of which is illustrated) is positioned within the mold so as to overlay the access units 12, each duct extending the entire length of the mold to the end walls thereof. The duct 14 includes interior partitions dividing it into a plurality of channels 16 and knock-outs 17 are provided for each channel. The access units 12 are dimensioned to span one or more of the channels 16. Concrete then is cast into the mold in a conventional manner so as to encapsulate duct 14 and surround the sidewalls of the access units 12. After the concrete has cured, the casting is removed from the mold and is inverted whereby what was the bottom surface of the casting becomes the smooth top surface of the resultant concrete slab. The ends of duct 14 thereby are exposed, as are the outer open ends of the access units 12.

While the channel arrangement according to the preferred embodiment of the invention employs ductwork 14, it will be appreciated that hollow passageways instead may be formed in the poured concrete or parallel pipes be substituted for the ductwork. The ducts or pipes may be formed of metal or plastic.

Figure 2:
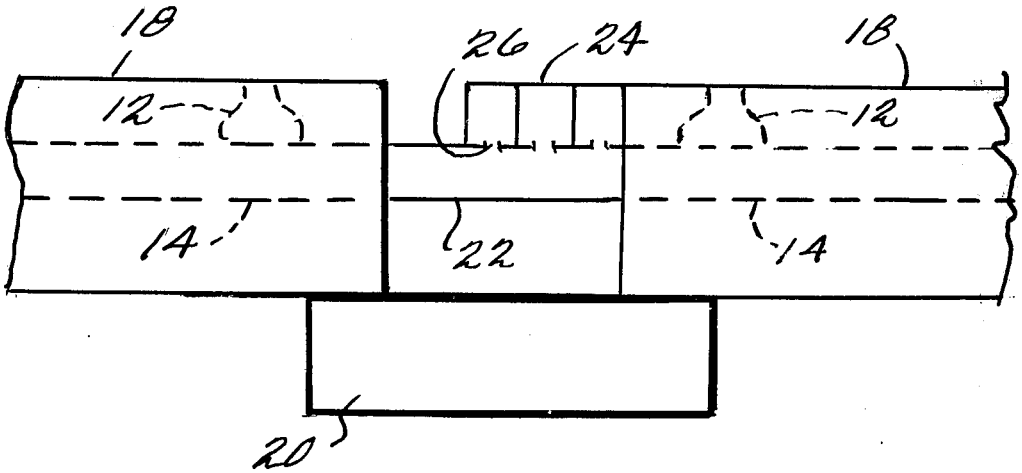

FIG. 2 illustrates how slabs formed in the manner just described are assembled to form a building floor. The end portions of two slabs 18 are positioned to rest in spaced relationship on a support beam 20 of the building. When so positioned, ducts 14 in the respective slabs are axially oriented. The ducts are joined by a connector 22 which, like ducts 14, is provided with interior partitions to separate the connector into plural channels, each associated with corresponding channels within the ducts 14. A header 24 is positioned between the ends of slabs 18 in an overlying relationship with respect to the connector 22 and extending normal to the longitudinal axes of ducts 14. This header is also partitioned into plural interior channels and suitable knockouts 26 are provided in each connector 22 so as to permit access from a given channel within header 24 to an associated channel within duct 14. The top surface of the header comprises a removable plate to permit access to the intersections of the header and connectors 22.

Once the header has been positioned as just described, the floor is completed by pouring concrete within the area between the ends of slabs 18 over beam 20 so as to encapsulate the connector 22 and the side(s) of header 24, and the concrete so poured is finished at the upper level of slabs 18 and the header 24 so as to form a continuous, smooth surface.

By utilizing preformed slabs in the manner just described to form a floor assembly, the only concrete which must be poured at the construction site is the limited amount required to fill the area between the ends of the slabs 18. It is evident, therefore, that the procedure just described avoids the extensive and costly on-site pouring required by prior art techniques. Therefore, the present invention permits a floor to be constructed in an expeditious and economical manner, with a minimum amount of concrete finishing.

While in the illustrative embodiment just described the header 24 is provided with a top plate flush with the level of the finished floor, it should be appreciated that the top of the header can be positioned below the floor level with conventional access units selectively positioned along the header and extending up to the level of the floor. In this case it is obvious that the concrete poured between the ends of the slabs will surround the sides of the access units associated with the header.

What is claimed is:

1. A method of forming a floor assembly from precast concrete slabs each provided with interior parallel channels extending from end-to-end of the slab, said method comprising the steps of:

supporting the ends of at least two slabs in spaced relationship with their respective channels axially oriented;

positioning connectors in axial alignment with said channels to interconnect the channels of adjacent slabs;

positioning a header having at least one channel therein in overlying relationship with respect to said connectors in the space between the ends of said slabs, the channel within said header extending in a direction substantially normal to the axial orientation of the channels in said slabs; and pouring concrete between the ends of the slabs to fill the area left unoccupied by the connectors and said header.

* * * * *